United States Patent [19]

Hemmerich

[11] 4,364,235

[45] Dec. 21, 1982

[54] HELIUM-COOLED COLD SURFACE, ESPECIALLY FOR A CRYOPUMP

[75] Inventor: Johann Hemmerich, Jülich, Fed. Rep. of Germany

[73] Assignee: Kernforschungsanlage Jülich GmbH, Jülich, Fed. Rep. of Germany

[21] Appl. No.: 238,770

[22] Filed: Feb. 27, 1981

[30] Foreign Application Priority Data

Mar. 4, 1980 [DE] Fed. Rep. of Germany ..... 3008128

[51] Int. Cl.[3] ..... B04D 8/00

[52] U.S. Cl. ..... 62/55.5; 55/269; 62/514 R; 417/901

[58] Field of Search ..... 62/55.5, 100, 268, 514 R; 55/269; 417/901

[56] References Cited

U.S. PATENT DOCUMENTS 3,252,652 5/1966 Trendelenbubg et al. ..... 62/55.5

*Primary Examiner*—Ronald C. Capossela

*Attorney, Agent, or Firm*—Karl F. Ross

[57] ABSTRACT

A cold surface, (e.g. for use in a so-called cryopump, i.e. a cryogenic vacuum vapor pump), is formed by a reservoir for liquid hydrogen surrounded by a double-wall vessel over an intervening evacuated insulating space. The lowest points of the compartment formed between the walls of the double-wall vessel and the interior of the liquid helium reservoir are connected by a conduit provided with a valve.

8 Claims, 3 Drawing Figures

HELIUM-COOLED COLD SURFACE, ESPECIALLY FOR A CRYOPUMP

CROSS REFERENCE TO RELATED APPLICATION

This application is related to my copending application Ser. No. 092,660 filed Nov. 9, 1979 and entitled THERMAL RADIATION SHIELD (now U.S. Pat. No. 4,267,707).

FIELD OF THE INVENTION

My present invention relates to a helium-cooled cold surface and, more particularly, to a deep-cooled surface forming part of a high vacuum vapor pump, i.e. a cryopump.

BACKGROUND OF THE INVENTION

As pointed out in U.S. Pat. No. 3,252,652 and other literature which may be found in the file of the above mentioned copending application, it is possible to produce a high-vacuum by the attachment of gas molecules to a deep cooled surface which can be termed a cryosurface, the apparatus for this purpose being referred to as a cryopump.

The surface is cooled by contacting it with liquid helium, e.g. on a side thereof opposite that at which attachment of the gas molecules will occur.

When a cryopump of conventional design and high gas-removal capacity is used to generate high vacuums, various problems are encountered.

Cryopumps do not remove the pumped gas from the receptacle system to be evacuated but rather freeze out the gas by condensation and/or suction on the deep-cooled surface or cryosurface. Combustible gases, when these are to be abstracted, for example hydrogen, create the possibility that explosive mixtures will develop. This is the case especially when a highly efficient cryopump removes a large quantity of gas from the atmosphere in the vacuum system and thus a large volume of the gas is collected at the pump surface and must be vented. This venting is desirable to renew access to the cryosurface and may even occur spontaneously at undesired times because of operating failures or oversights.

It is essential to remove the condensed layer from time to time in any event because, with increasing thickness of the condensate layer, there is an increase in emissivity and an associated increase in the coolant demand at the cryosurface.

Furthermore, when the gas includes a radioactive isotope of hydrogen, tritium, as is the case in fusion experiments, relatively large quantities of this radionuclide (0.1 to 1 kg.) can collect on the cryosurface and not only create the danger of explosion but also the danger that any sudden or spontaneous release of the collected gas may liberate large quantities of a radioactive and hence dangerous substance.

These problems can be sharply reduced or avoided when the deep-cooled surface of the cryopump is frequently thawed, i.e. freed from the condensate, and the liberated gas and comparatively high pressure and high throughput is discharged by a pump of relatively low suction capacity, e.g. a turbomolecular pump and fed to a processing station.

This requires warming of the cryosurface or the condensation surface by temporarily interrupting the contact therewith with the liquid helium and thus by emptying the liquid helium from the vessel of which this surface forms a part. This requires discharging the liquid helium from the vessel and the usual ducts and supply containers which are in vacuum-tight connection with the receptacle. When the cryosurface is again to be cooled, the liquid helium must be returned.

This two-fold transfer of large amounts of liquid helium between the pump and an external reservoir is time-consuming and generally is accompanied by large liquid helium losses.

OBJECTS OF THE INVENTION

It is thus the principal object of the present invention to provide an improved system including a helium-cooled cryosurface whereby the disadvantages of earlier systems are avoided.

Another object of the invention is to provide an assembly including a cryosurface, especially a condensate collecting surface for a cryopump which minimizes the liquid helium losses resulting from the need to frequently thaw the surface and release collected gas therefrom.

It is another object of the invention to improve the economy and operating efficiency of such helium-cooled surfaces.

SUMMARY OF THE INVENTION

These objects and others which will become apparent hereinafter are attained, in accordance with the present invention, in a system which provides a helium-cooled surface as part of a double-wall jacket surrounding a liquid helium reservoir, the space between the walls of this jacket being connected at its lowest point with the lowest point of the liquid helium reservoir enclosed thereby. The double-wall jacket is separated from the liquid helium reservoir by a thermally insulated, especially an evacuated, compartment.

With the system of the present invention the cold surface is formed by the outer surface of the outer wall of the double-wall jacket which encloses over the insulating space the liquid helium reservoir to enable a rapid discharge, preferably by the application of a controlled pressure differential between the compartment formed between the walls of the jacket and the compartment formed in the liquid helium reservoir, into the latter with no liquid helium losses during the transfer period.

After the gas collected on the deep-cooled surface has evaporated or sublimed or is desorbed, the compartment between the walls of the jacket can be filled from the reservoir, again without losses.

It has been found to be especially advantageous to provide an additional valve between the lowest point of the jacket compartment and the upper end of the liquid helium reservoir enclosed thereby so that the cold helium gas from the reservoir can be used for cooling the jacket thereby reducing the consumption of liquid helium.

Advantageously, the reservoir compartment and the double-wall jacket compartment each have a gas outlet at the upper end of the system connected to a valve arrangement or the like for establishing the pressure differential across the compartments to replace the liquid from the reservoir into the jacket department and from the jacket department into the reservoir in the manner described below.

Thus the wall which is deep-cooled with the liquid helium can be formed as the outer surface of a jacket between two walls so that the jacket compartment forms a single uninterrupted continuous space which can be filled with the liquid helium and can define the cryosurface. Alternatively the cryosurface can be defined by the outer surface of liquid helium receiver or filled tubes defining a cylindrical cage or the like.

The space between the jacket and the reservoir can be provided with a cryosorption agent, preferably in the form of a layer to reduce the pressure in the intervening space still further. Most advantageously, this layer is applied to the outer surface of the liquid helium reservoir which is surrounded by the jacket.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
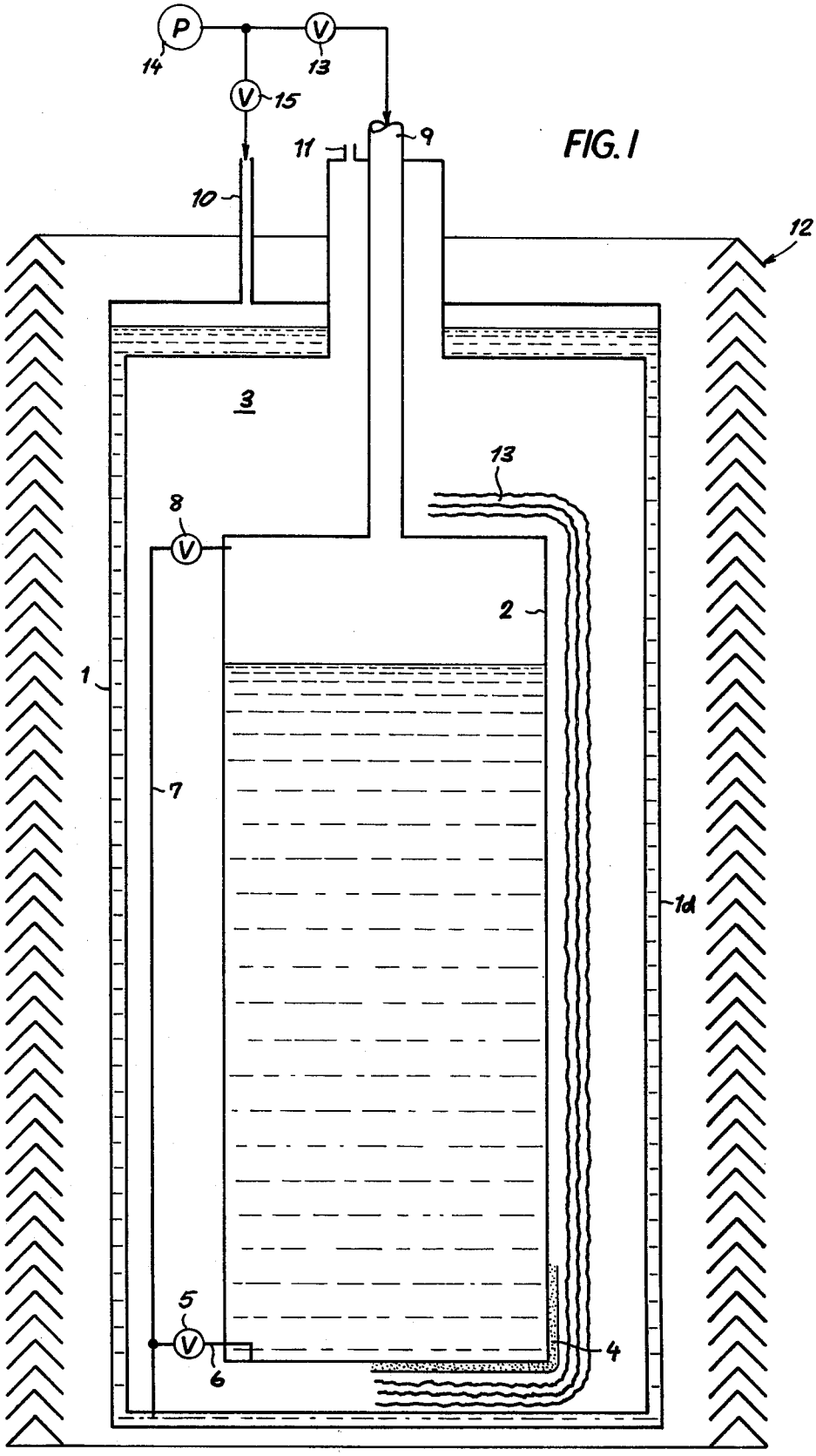
FIG. 1 is a vertical cross sectional view through a cooling surface for a cryopump, diagrammatically illustrating the principles of the present invention.

As will be apparent from the diagram of FIG. 1 a cryosurface 1*d* is formed by a wall 1 having an internal compartment, i.e. a double-wall jacket, enclosing a liquid helium reservoir 2 which is separated from the jacket 1 by a highly insulated space 3. The liquid helium reservoir 2 has a liquid helium capacity at least equal to that of the compartment within the jacket 1.

The space 3 can be highly evacuated and to further maintain an extremely low pressure therein, can be provided with a cryptosorption agent 4, which is formed as a layer upon the outer surface of the reservoir 2. In addition the space 3 can receive a multilayer heat-radiation sheet 13 which completely encloses the reservoir 2 and prevents radiant heat transfer across the space 13 by forming an optical barrier thereacross. Naturally this reduces the liquid helium loss from the reservoir by heat radiation from the cold surface as it forms for venting of gases collected upon the surface 1*d*.

Figure 2:
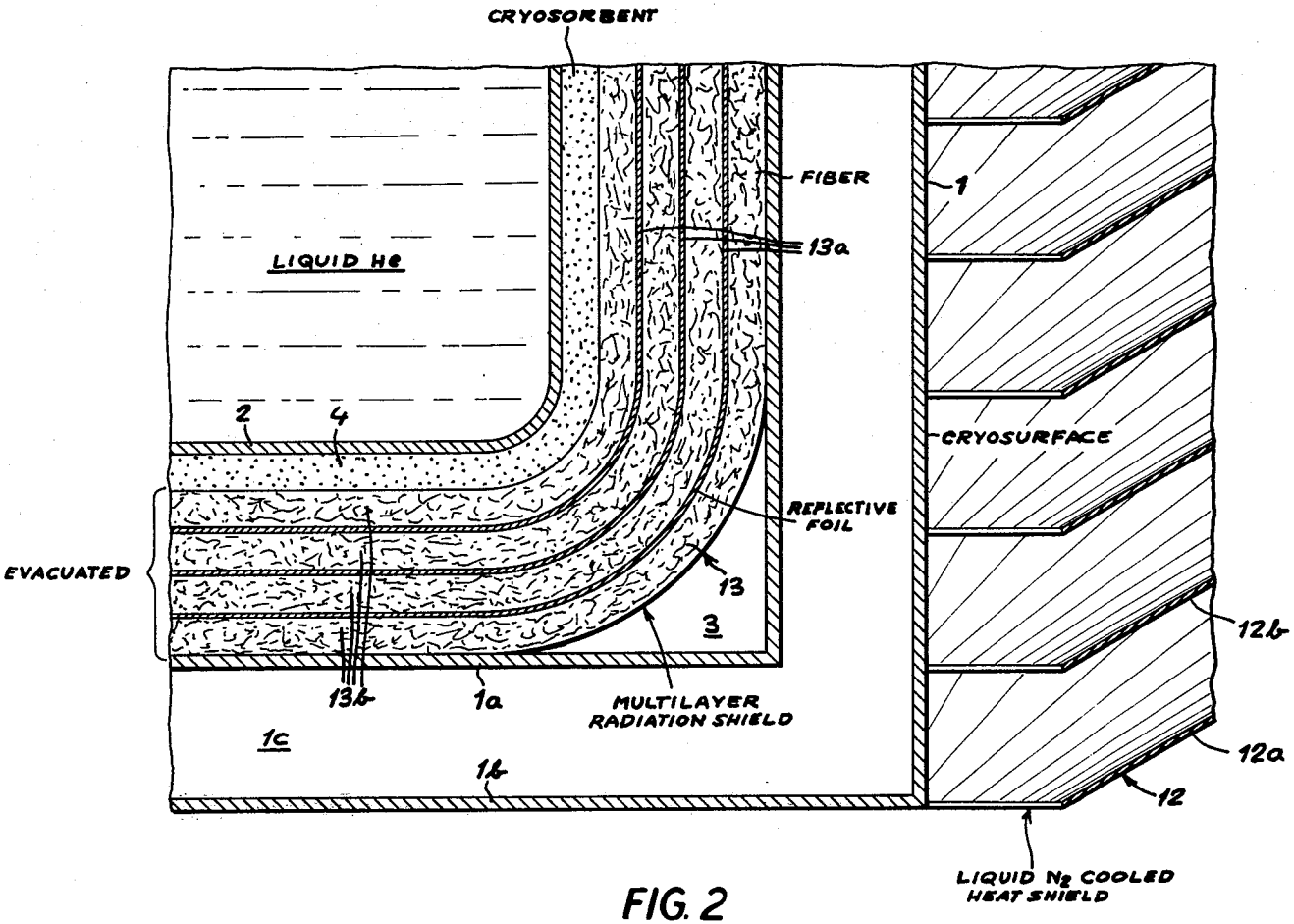
FIG. 2 is a detailed section of a portion thereof.

This insulation 13, as can be seen in FIG. 2, can comprise alternating layers 13*a* and 13*b* of highly reflective foil and fiber and in the cryogenic arts is termed a superinsulation.

The connecting duct 6 is provided between the lowest point of the reservoir 2 and the lowest point in the compartment of jacket 1 and includes a valve 5 which can assist in throttling the flow therebetween and thus facilitate the application of a pressure differential between the compartments to drive the liquid helium from one to another and back with the thermal losses in the duct system.

In addition duct 7 runs from the upper end of the reservoir to the lowest point within the double-wall jacket 1 and includes a valve 8. When the cryosurface 1*d* is to be cooled before the liquid helium is transferred, valve 8 is opened to admit cold helium gas from the top of the reservoir 2 into the jacket compartment to precool the latter. Thereafter the liquid helium is transferred.

Liquid helium can be supplied initially to the system through the pipe 9 and between the pipe 9 and the pipe 10 connected with the interior compartment of the jacket, a control system represented by the valves 15 and 13, connected to a pressure source 14 can be provided to establish a predetermined pressure differential in favor of displacement of liquid helium from the reservoir 2 into the jacket compartment for cooling of the surface 1*d* and from the jacket compartment into the reservoir 2 for the warming of the condensation surface 1*d*.

The jacket 1 serves as a cooling surface for a cryopump and is surrounded by a gas permeable heat radiation shield 12 which is cooled to liquid nitrogen temperature as described in my above mentioned copending application.

The system illustrated in FIG. 1 allows filling the jacket 1 from the reservoir 2 quasicontinuously with a constant supply of helium and a return of liquid helium into the reservoir for rapid evaporation upon interruption of the vacuum in the cryopump.

Helium losses during all phases are reduced since it is not necessary to transfer the liquid helium into an external reservoir, the helium remaining in the interior reservoir of the cryopump.

In a stand-by mode of operation, the liquid helium can be returned to the reservoir so the losses are reduced to those customarily encountered with helium Dewar flasks, i.e. 0.5 liters per day, independently of the size of the cryosurface whereas a cryosurface cooled in the conventional way has a stand-by loss of 0.5 liters per hour per square meter of the cryosurface.

The construction of the system of FIG. 1, in which the jacket 1 defines a continuous single compartment 1*c* between two walls 1*a* and 1*b*, has been shown in greater detail in FIG. 2 which also shows the individual plates 12*a* and 12*b* of the heat shield 12.

Figure 3:
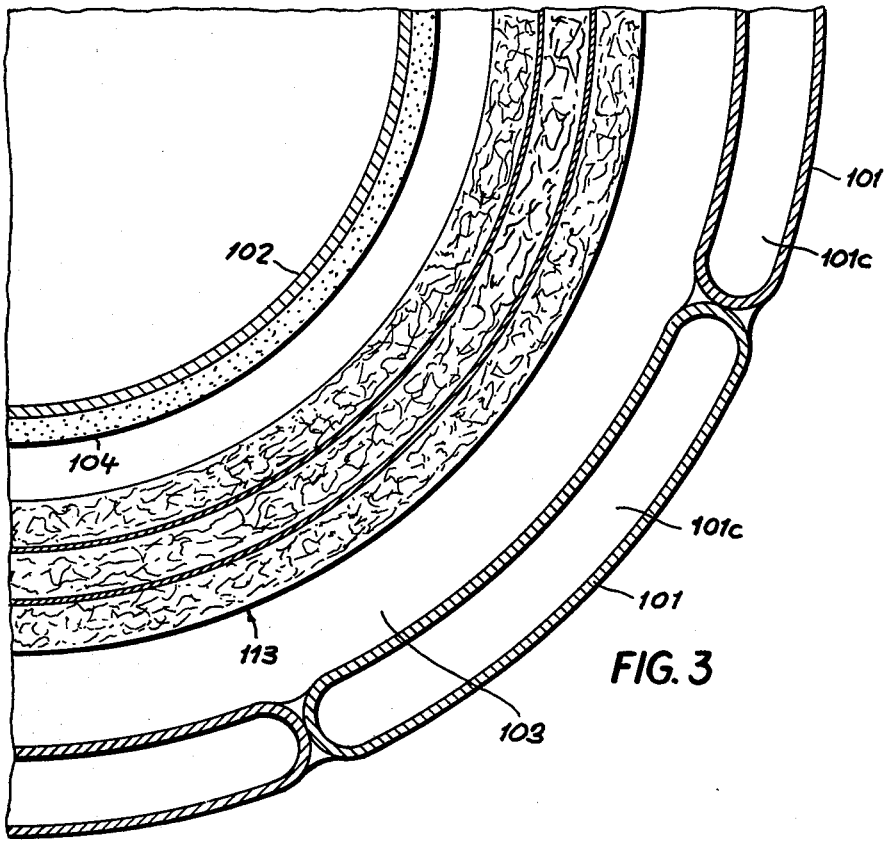
FIG. 3 is a horizontal section through another embodiment of the invention.

FIG. 3 illustrates another embodiment of the invention in which compartments 101*c* are formed by tubes 101 collectively disposed in a cage configuration, each of the tubes 101 being connected to its bottom by a respective valve to the low point of the reservoir 102 externally lined with the cryosorption layer 104. Within the space 103 a layer of superinsulation is provided.

Naturally, when the compartments 101*c* communicate with one another, only a single valve arrangement of FIG. 1 shown at 5 need by provided between the bottom of the compartments 101*c* and the bottom of the reservoir 102.

I claim:

1. A deep-cooled assembly especially adapted to form a cryosurface for a cryopump, comprising:

a liquid helium reservoir;

a double-wall outer vessel spacedly surrounding said reservoir and formed with at least one deep-cooled surface and at least one compartment formed between walls of said vessel;

a duct connecting the bottom of said compartment with the bottom of the interior of said receptacle and provided with a duct whereby said deep-cooled surface is cooled by transfer of liquid helium from said reservoir into said compartment through said duct and said surface is warmed upon transfer of liquid helium from said compartment through said duct into said reservoir; and means for thermally insulating the space between said reservoir and said vessel.

2. The assembly defined in claim 1, further comprising a conduit connecting the bottom of said compartment with the top of said reservoir and provided with a further valve for admitting cold helium gas from said reservoir into said compartment to cool said surface.

3. The assembly defined in claim 1, further comprising a gas outlet at the top of said compartment.

4. The assembly defined in claim 1, further comprising means connected to the top of said compartment and to the top of said reservoir for applying a pressure differential across liquid helium to displace liquid helium from said reservoir into said compartment and from said compartment into said reservoir selectively.

5. The assembly defined in claim 1 wherein said vessel is a double-wall jacket surrounding said reservoir whereby said compartment is continuous and completely surrounds said reservoir.

6. The assembly defined in claim 1, claim 2, claim 3, claim 4 or claim 5, further comprising a cryosorption agent in said space for maintaining a low pressure therein.

7. The assembly defined in claim 6, further comprising a multilayer heat-reflective radiation shield in said space.

8. The assembly defined in claim 7, further comprising a gas-permeable radiation barrier surrounding said vessel.

* * * * *